United States Patent [19]

Wakabayashi

[11] Patent Number: 4,498,399

[45] Date of Patent: Feb. 12, 1985

[54] FREE LINE SWITCH ARRANGEMENT FOR POWER-AND-FREE TROLLEY CONVEYOR

[75] Inventor: Takao Wakabayashi, Toyonaka, Japan

[73] Assignee: Nakanishi Metal Works Co., Ltd., Osaka, Japan

[21] Appl. No.: 324,598

[22] Filed: Nov. 24, 1981

[30] Foreign Application Priority Data

Nov. 28, 1980 [JP] Japan ..... 55-172008[U]

[51] Int. Cl.[3] ..... E01B 25/26

[52] U.S. Cl. ..... 104/96; 104/103; 104/130; 104/172 S

[58] Field of Search ..... 104/96, 99, 103, 130, 104/172 S, 89, 91

[56] References Cited

U.S. PATENT DOCUMENTS 2,586,264 2/1952 Rose ..... 104/99
3,434,431 3/1969 Dehne ..... 104/172 S
3,602,148 8/1971 Swartz ..... 104/172 S
4,341,161 7/1982 Morita et al. ..... 104/89 X

FOREIGN PATENT DOCUMENTS 2600722 7/1977 Fed. Rep. of Germany ..... 104/130

*Primary Examiner*—Randolph Reese
*Assistant Examiner*—Gregory Beehner
*Attorney, Agent, or Firm*—Armstrong, Nikaido, Marmelstein & Kubovcik

[57] ABSTRACT

A first free line composed of two rails arranged in parallel in a substantially horizontal plane is joined to a second free line composed of two rails arranged in parallel in the substantially horizontal plane. A switch rail pivotally movable in the substantially horizontal plane is provided at each of the junctions where the rails of the first free line are joined to the rails of the second free line in corresponding relation. Another switch rail pivotally movable in the substantially horizontal plane is provided at a cutout portion formed in the intersection of one of the first free line rails with one of the second free line rails.

7 Claims, 8 Drawing Figures

16
16
23
17
10
22
24
5
6
3
4
9
1
25
25
2

23
16
16
17
22
24
10
5
6
9
25
25
3
4
2
1

FREE LINE SWITCH ARRANGEMENT FOR POWER-AND-FREE TROLLEY CONVEYOR

BACKGROUND OF THE INVENTION

The present invention relates to a free line switch arrangement for power-and-free trolley conveyors wherein the free line comprises two rails.

Conventional power-and-free trolley conveyors comprise a free line rail extending immediately below a power line rail and carriers suspended from the free line rail and each thereby supported at its center portion. Accordingly the power line rail, free line rail and other parts are positioned immediately above the article placed on the carrier, with the resulting likelihood that oil, dust, etc. will fall onto the article. To render the article on the carrier free from deposits such as oil and dust, we have already proposed a power-and-free trolley conveyor comprising a power line rail, a free line rail disposed immediately below the power line rail, another free line rail provided at one side of the free line rail in parallel thereto, and carriers suspended from the free line rails and each thereby supported at its opposite sides (Application for Japanese Utility Model Registration No. 172007/80). However, at a branch or confluent junction of free lines of such a trolley conveyor, the two rails of a first free line are joined to the two rails of a second free line, with one of the rails of one free line intersecting one of the rails of the other free line, so that the switch arrangement needed for diverting carriers at the branch or confluent junction generally becomes complex in construction.

SUMMARY OF THE INVENTION

The main object of the present invention is to provide a free line switch arrangement of simple construction which is adapted for use in power-and-free trolley conveyors comprising a free line composed of two rails and by which carriers can be smoothly diverted from one free line to another at a branch or confluent junction.

The above object can be fulfilled by a free line switch arrangement for a power-and-free trolley conveyor comprising a first free line composed of two rails arranged in parallel in a substantially horizontal plane, a second free line composed of two rails arranged in parallel in the substantially horizontal plane, the second free line being joined to the first free line, a switch rail pivotally movable in the substantially horizontal plane and provided at each of the junctions where the first free line rails are joined to the second free line rails in corresponding relation, and another switch rail pivotally movable in the substantially horizontal plane and provided at a cutout portion formed in the intersection of one of the first free line rails with one of the second free line rails.

BRIEF DESCRIPTION OF THE DRAWINGS

Throughout the drawings, like parts are referred to by like reference numerals.

DESCRIPTION OF THE PREFERRED EMBODIMENTS

Figure 1:
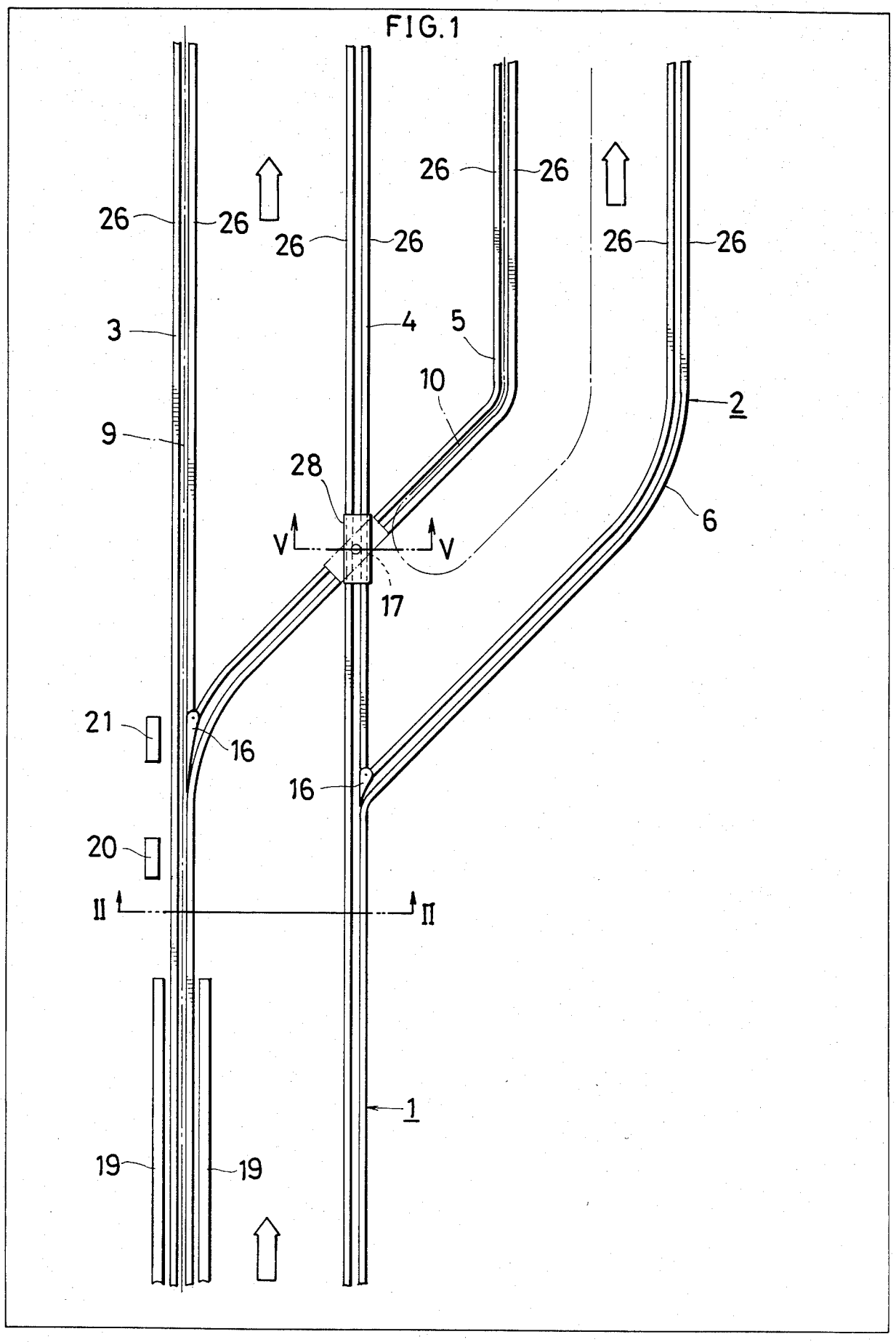
FIG. 1 is a plan view showing an embodiment of the invention.
Figure 2:
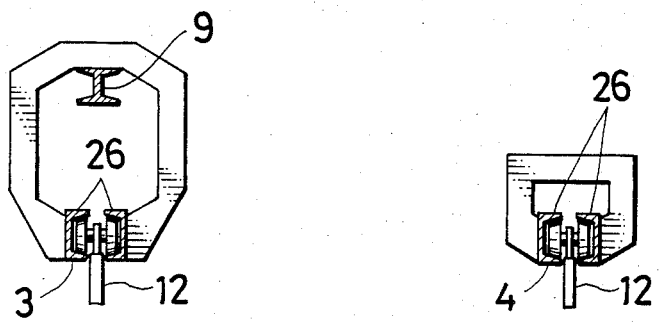
FIG. 2 is an enlarged view in section taken along the line II—II in FIG. 1.
Figure 3:
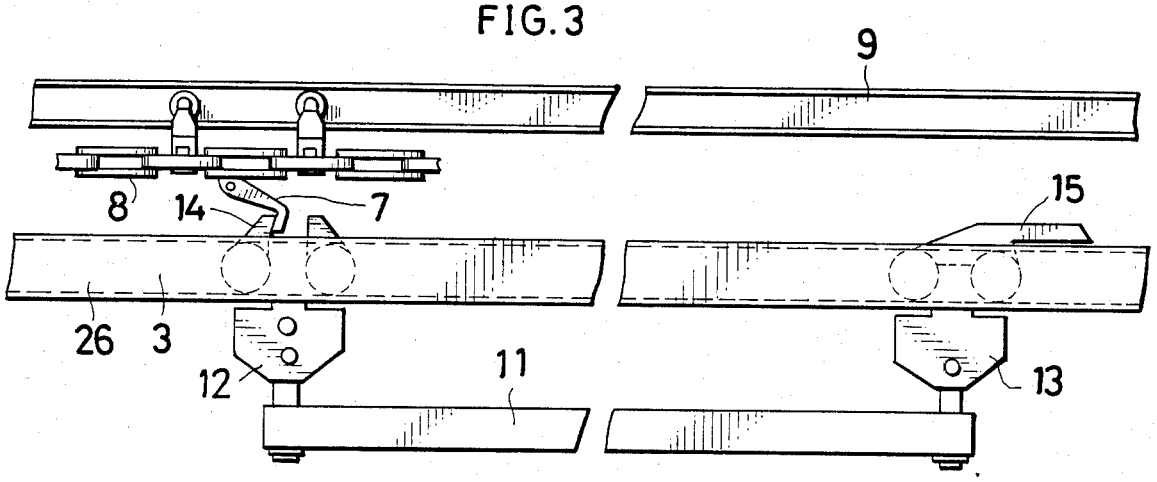
FIG. 3 is an enlarged side elevation showing part of FIG. 1.

FIG. 1 shows a first free line 1 and a second free line 2 joined to the line 1 at a branch junction. The free lines 1 and 2 comprise a pair of parallel rails 3, 4 and a pair of parallel rails 5, 6, respectively, which are arranged in the same substantially horizontal plane. Each of the rails 3, 4, 5, 6 comprises a pair of channel members 26 closely arranged with their openings opposed to each other (see FIG. 2). A first power line 9 provided with a drive chain 8 which is travelling at all times is disposed immediately above the rail 3 of the first free line 1 which rail does not intersect the rails 5, 6 of the second free line 2. The drive chain 8 carries pusher dogs 7 which are pivotally movable upward and downward (see FIG. 3). The rail 5 of the second free line 2 which rail branches from the rail 3 and intersects the other first free line rail 4 is provided with a second power line 10. The power line 10 is positioned immediately above the portion of the rail 5 which is located outside the two first free line rails 3, 4. A carrier 11 has front and rear free trolleys 12, 13 at each of its opposite sides. These free trolleys 12, 13 at the opposite sides are adapted to run along the pair of rails 3, 4 (or 5, 6) of the free line 1 (or 2). A tilting dog 14 is attached to the front free trolley 12 which is movable along the rail 3 (or 5) of the free line 1 (or 2) under the power line 9 (or 10). A cam 15 is attached to the rear free trolley 13 which runs on the same rail.

Figure 4:
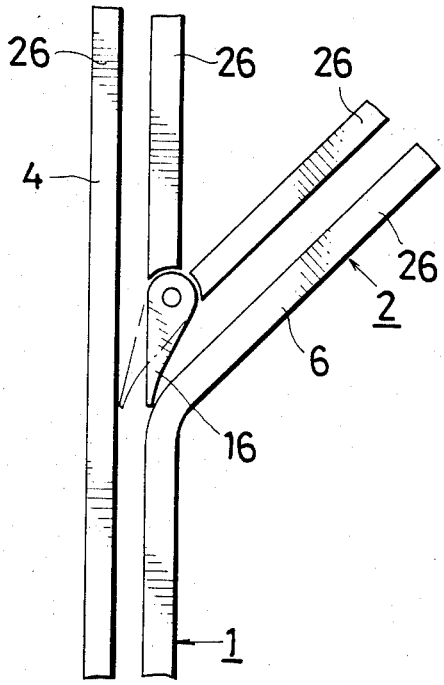
FIG. 4 is a fragmentary enlarged view of FIG. 1.
Figure 5:
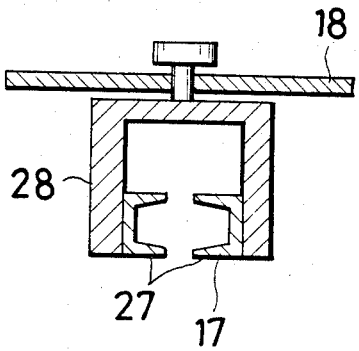
FIG. 5 is an enlarged view in section taken along the line V—V in FIG. 1.

Switch rails 16 which are pivotally movable in the above-mentioned substantially horizontal plane are provided individually at the junction of the first free line rail 3 and the second free line rail 5 and at the junction of the other first free line rail 4 and the other second free line rail 6 (see FIG. 4). The switch rails 16 are pivotably suspended from a frame (not shown) suspending the rails 3 to 6 and are pivotally moved by a hydraulic cylinder or the like to run carriers along the first free line 1 or, alternatively, to turn them from the line 1 to the second free line 2. Stated more specifically, at the junction of the first free line rail 3 and the second free line rail 5, one channel member 26 of the rail 3 is partly cut out. One channel member 26 of the second free line rail 5 is made continuous with one of the cutout ends of the channel member 26. The other channel member 26 of the rail 5 extends to a location close to the other cutout end. One end of the switch rail 16 is pivotably supported at a location close to the ends of the two inner channel members 26 included in the four channel members 26 at the junction of the two rails 3, 5. When the free other end of the switch rail 16 is joined to the above-mentioned one cutout end of the channel member 26 of the first free line rail 3, the switch rail 16 serves as part of the first free line 1 to provide a straight track along the line 1. Conversely when the free end of the switch rail 16 is joined to the other channel member 26 of the first free line rail 3, the switch rail 16 serves as part of the second free line 2 for the diversion of carriers along the line 2. The other switch rail 16 is arranged similarly at the junction of the other rail 4 of the first free line 1 and the other rail 6 of the second free line 2.

The first free line rail 4 and the second free line rail 5 are partly cut out at the intersection thereof. A switch rail 17 pivotally movable in the aforementioned substantially horizontal plane is provided in the cutout portion thus formed at the intersection. Like the free line rails 3 to 6, the switch rail 17 comprises a pair of channel members 27 which are closely arranged with their openings opposed to each other. These channel members 27 are fixed to inside lower portions of a pivotal member 28 having an inverted U-shaped cross section. The pivotal member 28 is turnably suspended from a frame 18 suspending the rails 4, 5. The pivotal member 28, when turned by a hydraulic cylinder or the like, selectively positions the switch rail 17 in alignment with the first free line rail 4 or the second free line rail 5.

Cams 19 movable upward and downward for pushing the carrier from behind are disposed at a distance upstream from the branch junction of the first free line rail 3 below the power rail 9 and the second free line rail 5. A cam 20 movable upward and downward for stopping the carrier is positioned close to the junction upstream therefrom. A pusher dog raising cam 21 which is movable upward and downward is disposed at the junction. The carrier pushing cams 19 are moved down when a carrier 11 is to be diverted to restrain a pusher dog 7 from moving upward, causing the pusher dog 7 to push the cam 15 on the rear free trolley 13 from behind. The carrier stopping cam 20, when moved up, pushes up a pusher dog 7 out of engagement with the tilting dog 14 on the front free trolley 12 to bring the carrier 11 to a halt. The pusher dog raising cam 21, when moved up, pushes up a pusher dog 7 to avoid the undesired interference of the dog 7 with the free trolleys 12, 13 when the carrier 11 is diverted.

When a carrier 11 is to be advanced straight on the first free line 1, the switch rails 16, 17 are aligned with the first free line 1 as seen in FIGS. 1 and 4, and the carrier pushing cams 19 are raised, with the other cams 20, 21 lowered, whereby the pusher dog 7 engaging the carrier 11 is allowed to advance along the first free line 1 without interfering with the cams 19, 20, 21 while pulling the carrier 11 along. At this time, the free trolleys 12, 13 pass over the switch rails 16, 17 and advance on the first free line 1.

When a carrier 11 is to be turned aside from the first free line 1 to the second free line 2, the carrier pushing cams 19 and the carrier stopping cam 20 are raised first. The pusher dog 7 advancing while pulling the carrier 11 along is therefore raised by coming into contact with the cam 20 and is disengaged from the tilting dog 14. The pushing dog 7 now advances singly along the first free line 1, while the carrier 11 comes to a halt at a location some distance upstream from the junction. At this time, the rear free trolley 13 of the carrier 11 is positioned below the carrier pushing cams 19. After the carrier 11 has stopped, the switch rails 16, 17 are turned into alignment with the second free line 2 as indicated in broken lines in FIGS. 1 and 4, and the cams 19 and 20 are lowered, while the cam 21 is raised. The switch rails 16, 17 may be so turned before the carrier 11 is stopped. With the parts thus positioned, another pusher dog 7, when reaching the location under the pushing cams 19, strikes against the cam 15 on the rear free trolley 13 and acts to pivotally move upward. However, since the pusher dog 7 is restrained from moving upward by the lower side of the pushing cams 19, the dog 7 is held in contact with the cam 15 and advances while pushing the carrier 11 from behind. Consequently the front free trolleys 12 at the opposite sides of the carrier 11 are transferred from the first free line rails 3, 4 to the second free line rails 5, 6 over the switch rails 16. The front free trolley 12 closer to the power line further passes over the switch rail 17 and reaches a position below the second power line 10. The front free trolley 12 is further advanced by being pulled by a pusher dog on the second power line 10, with the result that the rear free trolleys 13 at the opposite sides of the carrier 11 are similarly transferred to the second free line rails 5, 6. Thus the carrier 11 advances along the second free line 2.

Figure 6:
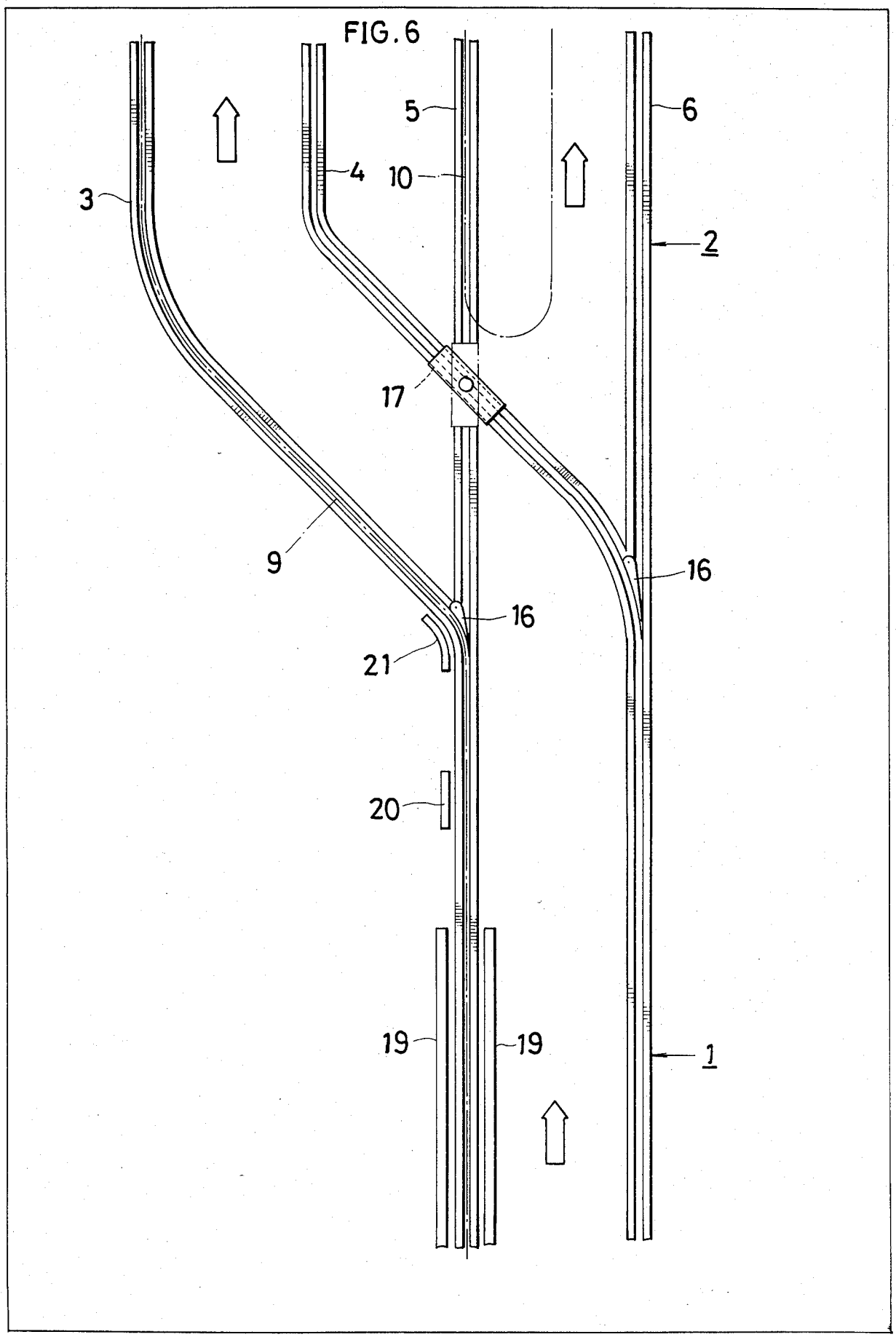
FIG. 6 is a plan view showing another embodiment of the invention.

FIG. 6 shows another free line branch junction embodying the invention. A second free line 2 branching from a first free line 1 which is bent extends straight from the portion of the first free line 1 upstream from its bent portion. With the exception of this feature, the second embodiment is similar to the first.

Figure 7:
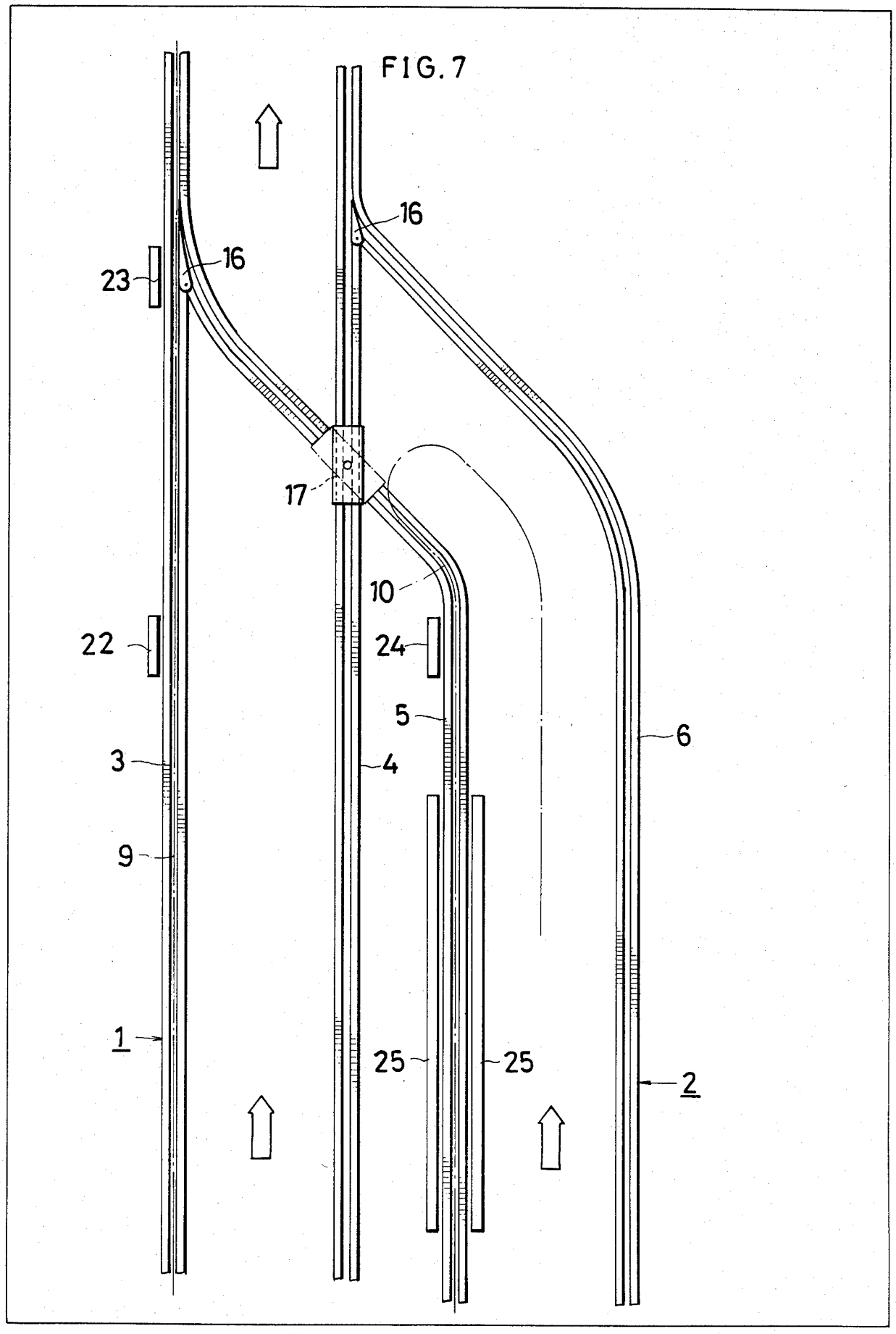
FIG. 7 is a plan view showing another embodiment of the invention.

FIG. 7 shows a free line confluent junction where a first free line 1 and a second free line 2, similar to those already described, are confluent. A carrier stopping cam 22 is disposed at a considerable distance upstream from the confluent junction of a first free line rail 3 below a power line 9 and a second free line rail 5. The cam 22 is similar to the cam 20. A pusher dog raising cam 23 is disposed at the confluent junction for preventing the pusher dog 7 from interfering with the free trolleys 12, 13 by pushing up the pusher dog 7 when the carrier 11 is turned from the second free line 2 to the first free line 1. The second free line rail 5 below a power line 10 is provided with a carrier stopping cam 24 similar to the cam 22. The cam 24 is disposed at a distance upstream from the intersection of a first free line rail 4 with the rail 5. Carrier pushing cams 25 similar to the cams 19 are arranged at a location upstream from the cam 24. With the exception of the above feature, this embodiment is similar to the first embodiment.

When a carrier 11 is to be turned from the second free line 2 to the first free line 1 with the above arrangement, the carrier stopping cam 24 and the carrier pushing cams 25 for the second free line 2 are raised first to stop the carrier 11 at a location some distance upstream from the intersection. If another carrier is travelling on the first free line 1 in the vicinity of the confluent arrangement, the first-mentioned carrier is held stopped for some time. In the absence of any carrier on the line 1 in the vicinity of the confluent arrangement or after the second-mentioned carrier has run away, the switch rails 16, 17 are turned into alignment with the second free line 2 as indicated in broken lines in FIG. 7, and the cams 24, 25 are lowered, while the cam 23 is raised. With the parts thus positioned, the pushing cams 25 cause a pusher dog 7 on the second power line 10 to push the carrier 11 from behind in the same manner as already described to advance the carrier. The front free trolley 12 on the rail 5 below the power line 10 is passed over the switch rail 17 and transferred from the second free line rail 5 to the first free line rail 3 over the switch rail 16 and reaches a location below the first power line 9. The carrier 11 is thereafter pulled along by a pusher dog 7 on the first power line 9 and advanced on the first free line 1.

To advance a carrier 11 straight along the first free line 1 when there is no carrier on the second free line 2 in the vicinity of the confluent arrangement, the switch rails 16, 17 are turned into alignment with the first free line 1 as seen in FIG. 7, and the cams 22, 23 are lowered. The pusher dog 7 pulling the carrier 11 then advances along the first free line 1. If another carrier is travelling on the second free line 2 in the vicinity of the confluent arrangement, the cam 22 is raised to temporarily stop the carrier 11 on the line 1. After the carrier from the second free line 2 has passed the confluent point, the switch rails 16, 17 are turned into alignment with the first free line 1, and the cams 22, 23 are lowered.

Figure 8:
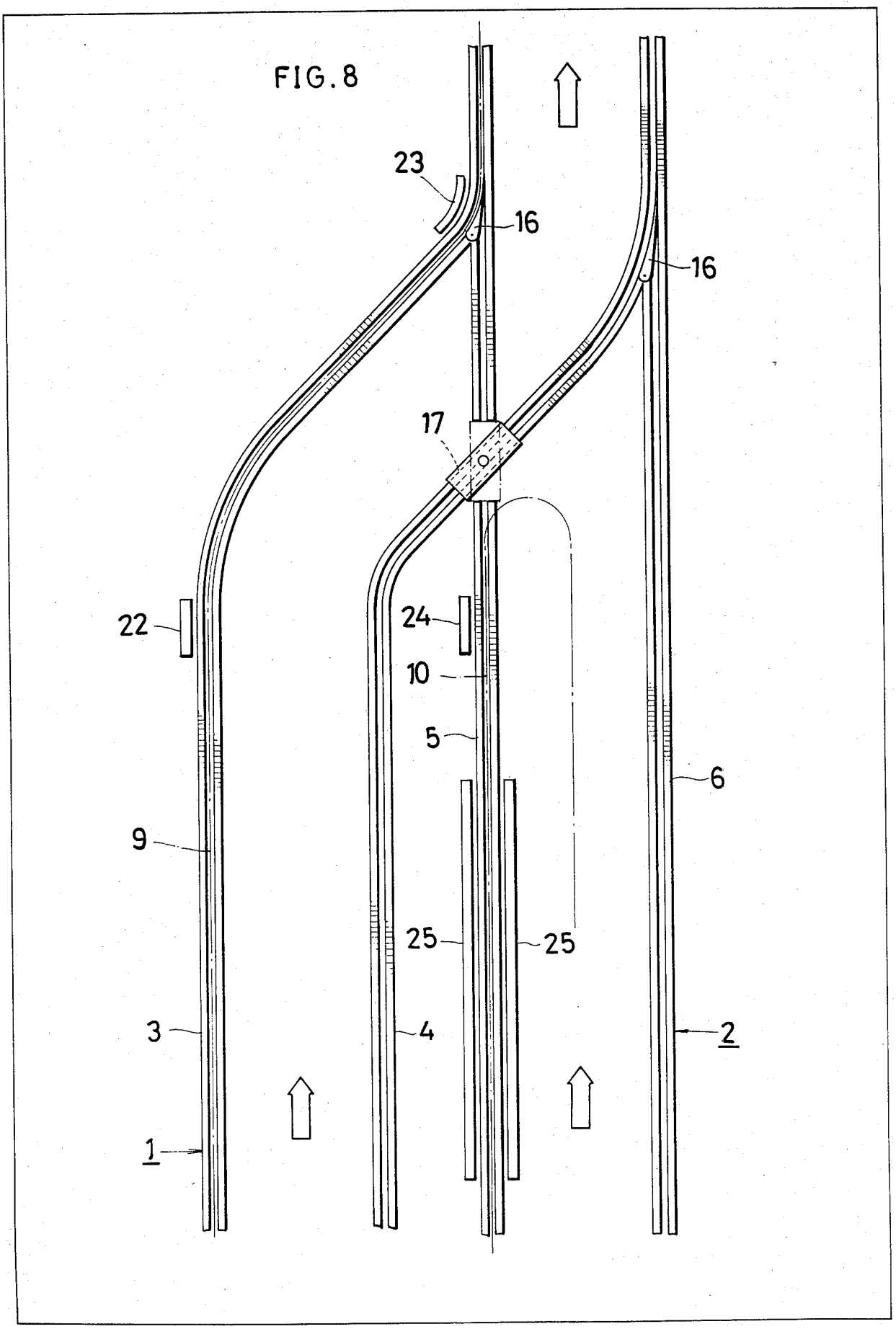
FIG. 8 is a plan view showing still another embodiment of the invention.

FIG. 8 shows another confluent junction embodying the invention. A second free line 2 joined to a bent first free line 1 extends straight in alignment with the portion of the first free line 1 downstream from its bent portion. With the exception of this feature, the embodiment is similar to the one shown in FIG. 7.

The means for transferring the carrier 11, the means for stopping the carrier 11 and the means for avoiding the interference of the pusher dog 7 with the free trolleys 12, 13 at the branch or confluent junction are not limited to the carrier pushing cams 19, 25, the carrier stopping cams 20, 22, 24 and the pusher dog raising cams 21, 23, but desired means are usable for these purposes. Further the power lines 9, 10, the free line rails 3, 4, 5, 6, the free trolleys 12, 13, the switch rails 16, 17, etc. can be suitably modified in construction and arrangement.

What is claimed is:

1. A free line switch arrangement for a power-and-free trolley conveyor comprising a first free line composed of a first left rail and a first right rail arranged in parallel in a substantially horizontal plane, a second free line composed of a second left rail and a second right rail arranged in parallel in said substantially horizontal plane, each of said rails comprising a pair of channel members closely arranged with their openings opposed to each other, said second free line being joined to said first free line, a first switch rail pivotally moveable in said substantially horizontal plane and provided at the junction of said first left rail and said second left rail, a second switch rail pivotally moveable in said substantially horizontal plane and provided at the junction of said first right rail and said second right rail, and a crossing switch rail pivotally moveable in said substantially horizontal plane and provided in a cut out portion in the rails at the position where one of said first rails crosses one of said second rails; one channel member of each of the first free line rails being partly cut out at each of said junctions of the first free line rails and the second free line rails, one channel member of each of the second free line rails being continuous with one of the cut out ends of said one channel member of the first free line rails, the other channel member of each of the second free line rails extending to a location close to the other cut out end, each of said first and second switch rails being pivotably suspended at its one end from a rail suspending frame at a location close to the ends of the two inner channel members included in the four channel members of the two rails at the junction, the free other end of each of the switch rails being selectively connectable to said one cut out end of said one channel member of the first free line rail or to the other channel member of the same first free line rail.

2. A free line switch arrangement as defined in claim 1, wherein the crossing switch rail comprises a pair of channel members closely arranged with their openings opposed to each other, and the channel members are fixed to a pivotal member turnably suspended from a rail suspending frame.

3. A free line switch arrangement as defined in claim 2 wherein carriers are suspended each at its opposite lateral sides from the right and left rails of one free line, and first and second power lines, each having a drive chain, are respectively provided immediately above the first left rail and immediately above the second left rail, the drive chain being provided with pusher dogs pivotally movable upward and downward for pulling and pushing the carriers

4. A free rail switch arrangement as defined in claim 3 wherein each of the carriers is provided at its opposite longitudinal ends with a front free trolley and a rear free trolley which are movable along the free line rails and the pusher dog pulls the front free trolley and is also adapted to push the rear free trolley from behind when the trolleys travel along the first left rail and the second left rail immediately below the pusher dog.

5. A free line switch arrangement as defined in claim 4 wherein the first power line is provided immediately above the first left rail which does not cross either of the second free line rails, and the second left rail which crosses the first right rail is provided with the second power line immediately above the portion of the second left rail which is located beyond the first free line rails.

6. A free line switch arrangement as defined in claim 5 which further comprises a carrier stopping cam movable upward and downward for stopping the carrier by pushing up the pusher dog out of engagement with the front free trolley and disposed at a distance upstream from the junction of the first left rail below the power line and the second left rail where the second left rail branches from the first left rail, a carrier pushing cam disposed at a location upstream from the carrier stopping cam and movable upward and downward for causing the pusher dog to push the rear free trolley from behind by restraining the pusher dog from moving upward, and a pusher dog raising cam disposed at the branch junction and movable upward and downward for preventing the pusher dog from interfering with the free trolleys by pushing up the pusher dog when the carrier is turned from the first free line to the second free line.

7. A free line switch arrangement as defined in claim 5 which further comprises a first carrier stopping cam movable upward and downward for stopping the carrier by pushing up the pusher dog out of engagement with the front free trolley and disposed at a distance upstream from the junction of the first left rail below the power line and the second left rail where the first and second left rails are confluent, a pusher dog raising cam disposed at the confluent junction and movable upward and downward for preventing the pusher dog from interfering with the free trolleys by pushing up the pusher dog when the carrier is turned from the second free line to the first free line, a second carrier stopping cam similar to the first carrier stopping cam and disposed at a distance upstream from the crossing of the first right rail with the second left rail below the power line, and a carrier pushing cam disposed at a location upstream from the second carrier stopping cam and movable upward and downward for causing the pusher dog to push the rear free trolley from behind by restraining the pusher dog from moving upward.

* * * * *